US008794210B2

(12) United States Patent
Liimatta et al.

(10) Patent No.: US 8,794,210 B2
(45) Date of Patent: Aug. 5, 2014

(54) ENGINE LUBRICATION SYSTEM

(75) Inventors: Gary David Liimatta, Milan, MI (US); Paul Shoemaker, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 419 days.

(21) Appl. No.: 13/344,549

(22) Filed: Jan. 5, 2012

(65) Prior Publication Data

US 2013/0174802 A1 Jul. 11, 2013

(51) Int. Cl.

| | |
|---|---|
| ***F01M 1/02*** | (2006.01) |
| ***B21K 3/00*** | (2006.01) |
| ***F01M 7/00*** | (2006.01) |

(52) U.S. Cl.

USPC ..... 123/196 R; 29/888.01; 184/109

(58) Field of Classification Search

USPC ..... 123/196 R, 195 R; 134/169 A; 184/1.5, 184/109; 29/888.01

See application file for complete search history.

(56) References Cited

U.S. PATENT DOCUMENTS

| | | | | |
|---|---|---|---|---|
| 3,813,299 | A * | 5/1974 | Bugor | 134/24 |
| 4,688,523 | A | 8/1987 | Takahashi et al. | |
| 4,951,784 | A * | 8/1990 | Bedi | 184/1.5 |
| 5,718,196 | A | 2/1998 | Uchiyama et al. | |
| 5,954,019 | A | 9/1999 | Yoshikawa et al. | |
| 6,173,689 | B1 | 1/2001 | Tanaka | |
| 6,298,947 | B1 * | 10/2001 | Flynn | 184/1.5 |
| 7,600,582 | B2 | 10/2009 | Wright, Jr. et al. | |
| 2005/0061289 | A1 | 3/2005 | Plenzler et al. | |

* cited by examiner

*Primary Examiner* — Noah Kamen

(74) *Attorney, Agent, or Firm* — Julia Voutyras; Alleman Hall McCoy Russell & Tuttle LLP

(57) ABSTRACT

A system for lubricating an engine is disclosed. In one example, the system includes an oil purging passage in fluidic communication with an oil gallery within an engine block. The system may provide for reduced engine degradation related to debris that may be found in engine oil.

20 Claims, 11 Drawing Sheets

ENGINE LUBRICATION SYSTEM

BACKGROUND/SUMMARY

Debris may be present in the oil within an engine during engine assembly. The debris may enter the engine from the external environment or from machining during engine manufacturing. For example, metal flakes and other debris produced during manufacturing of engine lubrication passages and other engine parts may enter the oil. Some engine lubrication systems are structured such that the debris may pass through various components such as cam phasers, valve adjusters (e.g., lash adjusters), bearings, tensioners, pistons, etc., before entering an oil filter where the debris may be removed from the oil. Therefore, during start-up of a "green" or new engine, unfiltered oil that includes debris may flow into the aforementioned components. As a result, the engine components may degrade, and the degraded components may degrade operation of the engine. An example of an engine lubrication system including a cam phaser positioned downstream of an oil filter and an oil pump is described in U.S. Patent Publication No. 2005/0061289.

The inventors herein have recognized the above-mentioned disadvantages of a closed lubrication system and have developed an engine lubrication system, comprising an engine block including an oil gallery passage extending through the engine block and supplying oil to a group of one or more moveable engine components, the oil gallery passage supplied oil from an oil pump, the oil gallery passage in fluidic communication with a drainage passage, and a movable stopper positioned in the drainage passage that selectively bypasses oil from the oil pump to an oil reservoir.

By bypassing engine oil around hydraulically operated devices and lubricated components of an engine before an engine is first operated, it may be possible to reduce engine component degradation. Specifically, the bypassed engine oil can be returned to an oil reservoir with the debris, and the debris can be filtered from the oil before the oil is used to lubricate engine components and operate hydraulic actuators. After debris is flushed from engine lubricating passages, the oil bypass passages may be closed so that oil is directed to engine components and hydraulically actuated devices.

The present description may provide several advantages. Specifically, the approach may reduce engine component degradation by allowing debris to be removed from engine oil before the engine oil passes through the components being lubricated. Further, the approach allows debris to be flushed from the interior of an engine without having to remove cylinder heads or crankshaft components. Further still, the approach provides quick access to engine oil passage flow regulating devices so that once the debris is flushed from oil passages, oil can be directed to engine components for lubrication and activation.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE FIGURES

FIGS. 4-10 show cross-sectional views of the engine assembly illustrated in FIGS. 3 and 4.

FIGS. 2-10 are drawn approximately to scale.

DETAILED DESCRIPTION

A lubrication system for draining an engine of oil prior to full assembly of the engine is described herein. The lubrication system may include an oil gallery passage having a drainage opening positioned near an end of the oil gallery passage. The opening may be un-sealed prior to a selected stage in an engine assembly process. While the oil gallery passage is unsealed, oil may flow through the oil gallery passage and into a drainage opening. The drainage opening may be in fluidic communication with an oil reservoir. Thus, engine oil can be pumped through the engine oil gallery passage to clear debris from the engine and oil. In this way, the engine lubrication system may be flushed prior to final engine assembly. The drainage opening is sealed after debris is flushed from the engine lubrication passage. The drainage opening may be sealed via a passage stopper positioned within the drainage opening itself or it may be sealed via a passage stopper inserted into the end of the oil gallery passage axially extending across the drainage opening.

Figure 1:
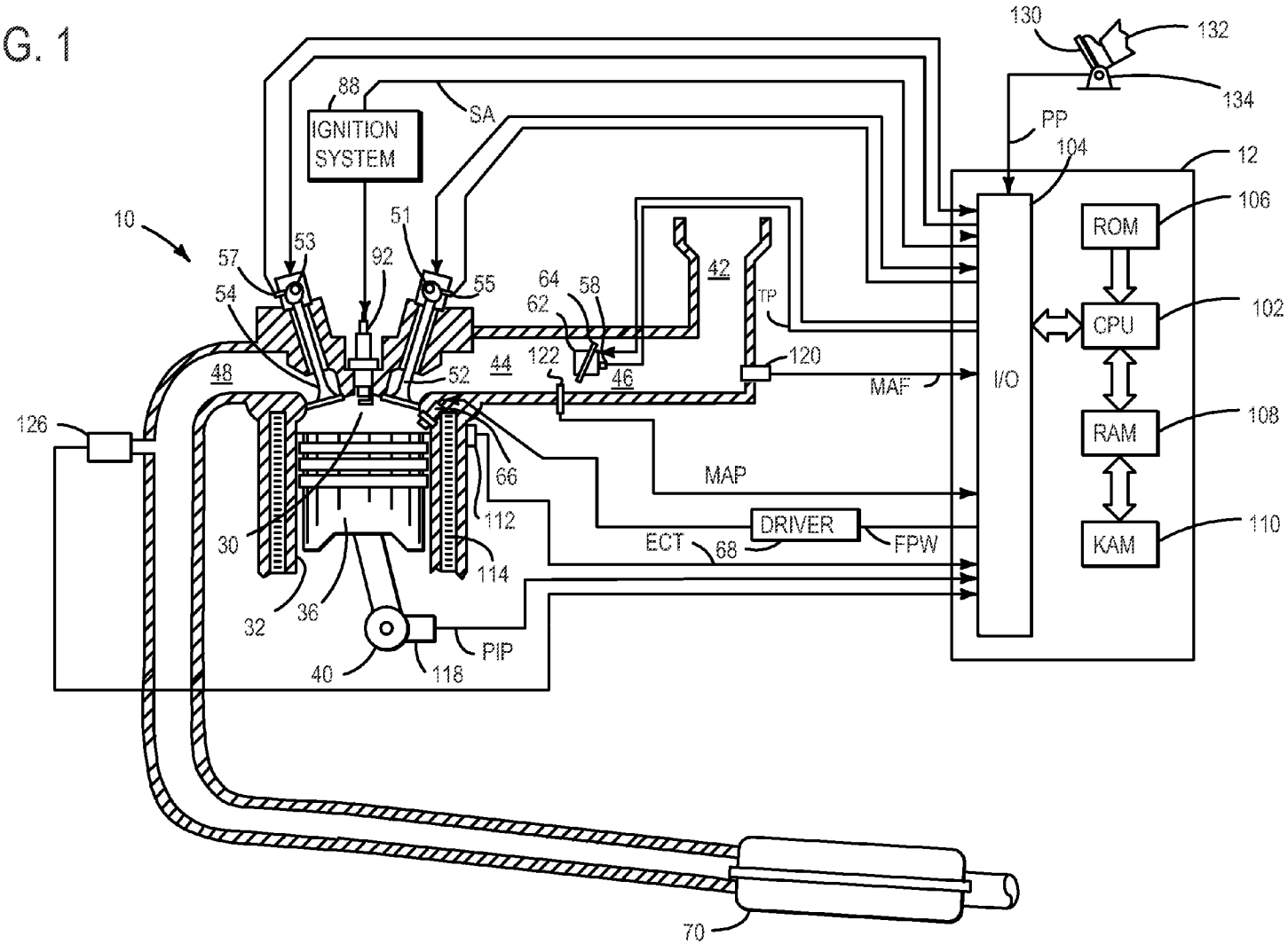
FIG. 1 shows a schematic depiction of an engine.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to a crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively or additionally, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown). Fuel injector 66 is supplied operating current from driver 68 which responds to controller 12. In addition, intake manifold 44 is shown communicating with optional electronic throttle 62 which adjusts a position of throttle plate 64 to control air flow from intake boost chamber 46. In other examples, the engine 10 may include a turbocharger having a compressor positioned in the intake system and a turbine positioned in the exhaust system. The turbine may be coupled to the compressor via a shaft. A high pressure, dual stage, fuel system may be used to generate higher fuel pressures at injectors 66.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by foot 132; a knock sensor for determining ignition of end gases (not shown); a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. The hybrid vehicle may have a parallel configuration, series configuration, or variation or combinations thereof. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples.

Figure 2:
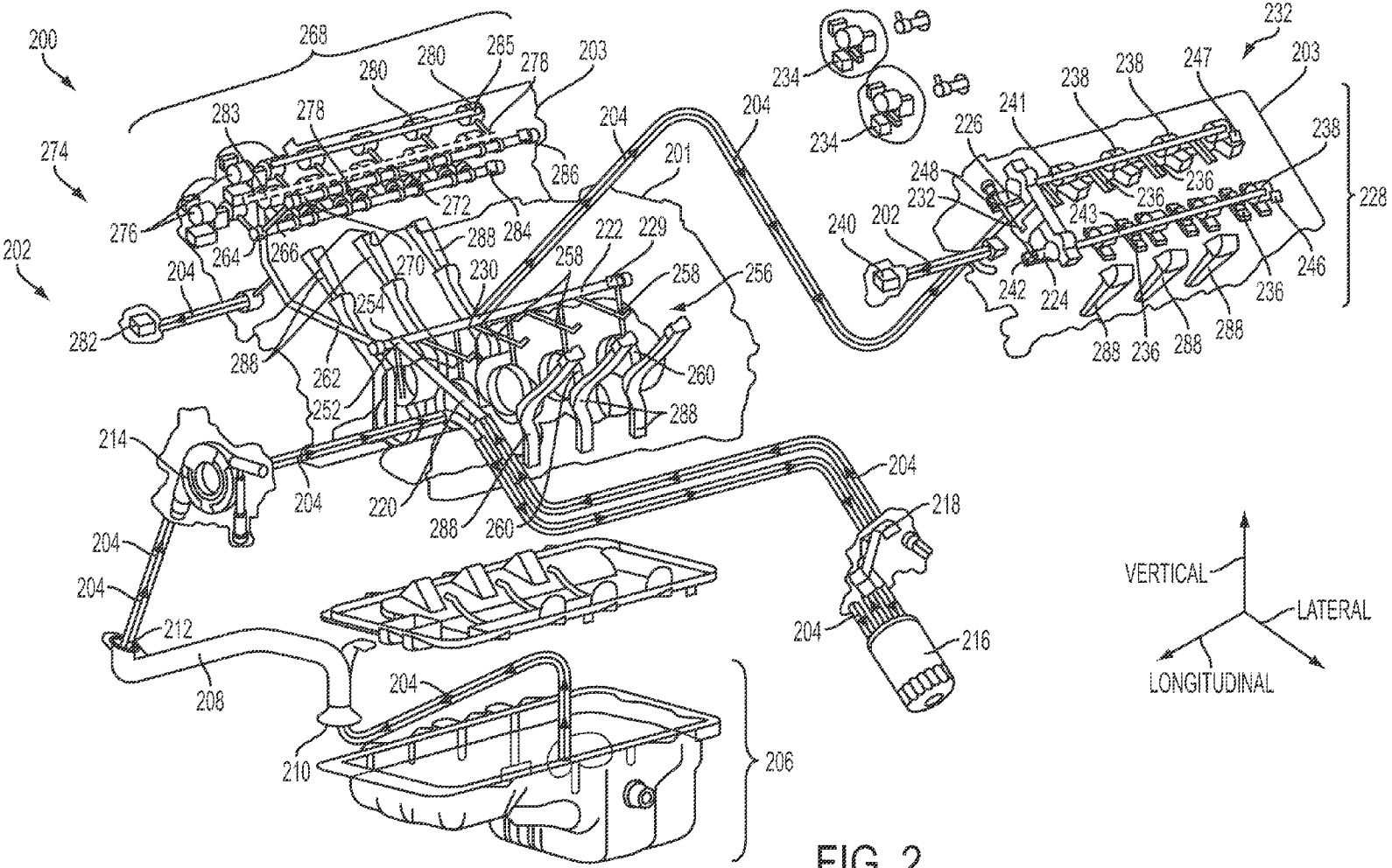
FIG. 2 shows a schematic depiction of a lubrication system in an engine assembly.

FIG. 2 shows a schematic depiction of an engine assembly 200 including a lubrication system 202. It will be appreciated that engine 10, shown in FIG. 1, may be included in the engine assembly 200 shown in FIG. 2. FIG. 2 depicts various components spaced apart for visual clarity. However, it will be appreciated that the components may be adjacent to one another. The engine assembly includes a cylinder block 201 and a first cylinder head 228 and a second cylinder head 268. The lubrication system 202 is configured to flow oil therethrough. It will be appreciated that the oil may be a synthetic oil, a non-synthetic oil, a bio-lubricant, a synthetic oil blend, or other suitable lubricant. Arrows 204 denote the general flow of lubricant through the lubrication system 202. However, it will be appreciated that the flow pattern of the lubricant in the lubrication system 202 may have additional complexity that is not illustrated.

The lubrication system 202 includes an oil reservoir 206 configured to hold oil or other suitable lubricant. A pick-up line 208 may be positioned in the oil reservoir 206 and includes an inlet 210 configured to receive oil from the oil reservoir 206. The pick-up line 208 further includes an outlet 212 in fluidic communication with the inlet 210 of a pump 214. The pump 214 may be configured to supply oil to components in the engine 10. The pump 214 is configured to generate a pressure head to enable the flow of oil to downstream components in the lubrication system 202. An oil filter 216 may be located directly downstream of the pump 214 in a series flow configuration. Therefore, a first passage in a series flow configuration has an outlet in direct fluid communication with an inlet of a second passage. It will be appreciated that the inlets or outlets of the two passages are not in direct fluidic communication in a series flow configuration. An oil filter supply component 218 may be positioned upstream of and in fluidic communication with the oil filter 216 configured to supply oil to and receive oil from the oil filter 216. Although in some examples, the oil filter supply component 218 may be part of the oil filter 216. The oil filter 216 may be configured to remove particulates from the oil. The outlet of the oil filter 216 is in fluidic communication with supply oil passage 220. Specifically, the oil filter supply component 218 provides a fluidic communication passage from oil filter 216 to supply oil passage 220.

The supply oil passage 220 supplies oil to a valley oil gallery passage 222 and a first oil gallery passage 224 and a second oil gallery passage 226 include in a first cylinder head 228. In particular, an oil passage 230 branches off from the supply oil passage 220. As shown, the first and second oil gallery passages (224 and 226) longitudinally extend through the first cylinder head 228. Additionally, the oil passage 230 is in fluidic communication with the first and second oil gallery passages (224 and 226) in a first cylinder head 228. It will be appreciated that the first cylinder head 228 may be coupled to the cylinder block 201 to form a cylinder bank. A cam cover may be coupled to the first cylinder head 228. The valley oil gallery passage 222 includes a drainage opening 229. The drainage opening may be sealed when the engine assembly 200 is a complete assembly. The valley oil gallery passage 222 is in fluidic communication with the oil reservoir 206 when the drainage opening 229 is unsealed. Therefore, it will be appreciated that the drainage opening 229 may be unsealed and configured to return oil to the oil reservoir 206 during engine construction when the engine assembly 200 is partially assembled. The drainage opening 229 may be unsealed when the engine is not combusting an air-fuel mixture. The drainage opening 229 is depicted via a generic box in FIG. 2. However, the geometric characteristics of the drainage opening 229 are illustrated in more detail in FIG. 6.

The first oil gallery passage 224 and the second oil gallery passage 226 included in the first cylinder head 228 are configured to supply oil to a plurality of moveable engine components 232 in a camshaft assembly. The moveable engine components 232 may include hydraulically operated devices.

Although a plurality of moveable engine components are depicted, it will be appreciated that in other examples, the first oil gallery passage 224 may be configured to supply oil to a single engine component. Moreover, it will be appreciated that the first oil gallery passage 224 may supply oil to components associated with intake valves and the second oil gallery passage 226 may supply oil to components associated with exhaust valves or vice-versa.

The moveable engine components 232 include cam phasers 234, valve adjusters (e.g., lash adjuster) 236, camshaft bearings 238, and/or a tensioner 240. The cam phasers 234 may be configured to alter the intake and/or exhaust valve timing. The valve adjusters 236 may be configured to actuate intake and/or exhaust valves. The camshaft bearings 238 may be configured to lubricate rotation of the intake and/or exhaust camshafts schematically depicted at 241 and 243. The tensioner 240 may be coupled to a cam driver (e.g., chain). The cam driver may be rotatably coupled to one or more of an intake camshaft, exhaust camshaft, and/or a crankshaft. The tensioner 240 may be configured to increase the tension of the cam driver.

The first oil gallery passage 224 includes an inlet 242 that is in fluidic communication with oil passage 230. The first oil gallery passage 224 includes a drainage opening 246 that is sealed when the engine assembly 200 is assembled. The drainage opening 246 may be unsealed and configured to return oil to the oil reservoir 206 during engine construction when the engine assembly 200 is partially assembled and/or the engine is not combusting an air-fuel mixture. In this way, the first oil gallery passage 224 may be flushed of any unwanted particulates in the lubrication system 202 during engine construction.

The oil passage 230 is also in fluidic communication with inlet 248 of the second oil gallery passage 226 included in the first cylinder head 228. As previously discussed, the second oil gallery passage 226 may be configured to supply oil to the moveable engine components 232.

The second oil gallery passage 226 also includes a drainage opening 247 that is sealed when the engine assembly 200 is assembled. The drainage opening 247 is in fluidic communication with the oil reservoir 206 when the passage is unsealed. Therefore, it will be appreciated that the drainage opening 247 may be unsealed and configured to return oil to the oil reservoir 206 during engine construction when the engine assembly 200 is partially assembled. The drainage opening 247 may be unsealed when the engine is not combusting an air-fuel mixture. The drainage openings (246 and 247) are schematically depicted via generic boxes in FIG. 2. However, the geometric characteristics of the drainage openings are illustrated in detail in FIG. 7.

The supply oil passage 220 is also in fluidic communication with valley oil gallery passage 222. Specifically, the valley oil gallery passage 222 is in fluidic communication with outlet 252 of the supply oil passage 220. As shown, the valley oil gallery passage 222 includes an inlet 254. The inlet 254 is positioned near a front engine cover engaging surface 304 shown in FIG. 3, discussed in greater detail herein. The valley oil gallery passage 222 is also in fluidic communication with a plurality of moveable engine components 256. The moveable engine components 256 may include hydraulically operated devices. The moveable engine components 256 include piston jets 258 and the bearings enclosed by the bearing caps 260. It will be appreciated that crankshaft bearings may be positioned within the bearing caps 260. The bearing caps 260, the crankshaft bearings, and the crankshaft may all be included in a crankshaft assembly. The piston jets 258 may be configured to spray oil onto pistons included in the first and/or second cylinder heads (228 and 268, respectively).

An oil passage 262 is in fluidic communication with the valley oil gallery passage 222. The oil passage 262 extends through a portion of the cylinder block 201 and the second cylinder head 268. The oil passage 262 is in fluidic communication with an inlet 264 of a first oil gallery passage 266 in the second cylinder head 268. Additionally, the oil passage 262 is in fluidic communication with an inlet 270 of a second oil gallery passage 272 included in the second cylinder head 268. The first and second oil gallery passages (266 and 272) included in the second cylinder head 268 are in fluidic communication with a plurality of moveable engine components 274. The moveable engine components 274 may include hydraulically operated devices. Specifically, the moveable engine components 274 include cam phasers 276, valve adjusters 278, camshaft bearings 280, and a tensioner 282. The aforementioned moveable engine components 274 may have similar functionality to the moveable engine components 232, described above. Additionally, camshafts in the second cylinder head 268 are schematically depicted at 283 and 285. Each cam shaft may be configured to actuate a set of intake valves or a set of exhaust valves.

The first oil gallery passage 266 includes a drainage opening 284. Likewise, the second oil gallery passage 272 includes a second drainage opening 286. The drainage openings (284 and 286) are positioned at an end of the corresponding oil gallery passages. The drainage openings (284 and 286) may be substantially sealed when the engine assembly 200 is assembled. However, during construction the drainage openings (284 and 286) may be unsealed and flushed when the engine assembly 200 is partially assembled. The drainage openings (284 and 286) are depicted via generic boxes in FIG. 2. However, the geometric characteristics of the drainage opening (284 and 286) are illustrated in greater detail in FIG. 9.

FIG. 2 also shows a plurality of reservoir return passages 288. The reservoir return passages 288 provide fluidic communication between enclosures in the first and second cylinder heads (228 and 268) as well as the crankcase and the oil reservoir 206. Therefore, oil may be flowed from the moveable engine components (232, 256, and 274) back to the oil reservoir via the reservoir return passages 288. In this way, oil may be delivered to various components in the engine for lubrication and then returned to the oil reservoir, thereby forming a lubrication circuit. Furthermore, oil may be flowed from the drainage openings (229, 246, 247, 284, and/or 286) back to the oil reservoir via the reservoir return passages 288 when the drainage openings are unsealed. The drainage opening may be unsealed during engine manufacturing. A technique for flushing the lubrication system is discussed in greater detail herein with regard to FIG. 11.

The oil reservoir 206, pick-up line 208, pump 214, oil filter 216, oil filter supply component 218, oil passages (230, 262), the supply oil passage 220, the valley oil gallery passage 222, the first and second oil gallery passages (224 and 226, respectively) included in the first cylinder head 228, the first and second oil gallery passages (264 and 270, respectively)

included in the second cylinder head 268, the moveable engine components (232, 256, and 274), and/or the reservoir return passages 288 may be included in the lubrication system 202.

It will be appreciated that the aforementioned oil gallery passages (e.g., the first oil gallery passage 224 included in the first cylinder head 228, the second oil gallery passage 226 included in the first cylinder head, the valley oil gallery passage 222, the first oil gallery passage 264 included in the second cylinder head 268, and the second oil gallery passage 270 included in the second cylinder head) may be generally referred to as a first oil gallery passage, a second oil gallery passage, etc.

In addition, the drain passages 229, 284, 286, 247, and 246 provide low resistance bypass passages from so that oil may be passed through the first oil gallery passage 224, the second oil gallery passage 226, the valley oil gallery passage 222, the first oil gallery passage 264, and the second oil gallery passage 270 and to the oil reservoir 206 without flowing oil through a group comprising at least one of bearings, lifters, cam actuators, and tensioners. In addition, oil may be directed through the drain passages 229, 284, 286, 247, and 246 via rotating the engine with drain stoppers positioned to allow flow through the drain passages. In this way, insufficient oil pressure is developed within the oil passages to allow for a substantial amount of oil to flow through the bearings, lifters, cam actuators, and tensioners. Thus, debris is directed away from hydraulic components and to the reservoir where it is pumped and removed through a filter.

It should also be mentioned that the drainage passages may be opened before combustion is initiated in the engine for a first time. Opening the drainage passages before combustion allows debris to be purged from engine oil passages before the engine is operated for the first time since being manufactured. Once the debris is purged from the oil passages, oil may be directed to engine components that move so that the components are lubricated when combustion commences in the engine for the first time.

Figure 3:
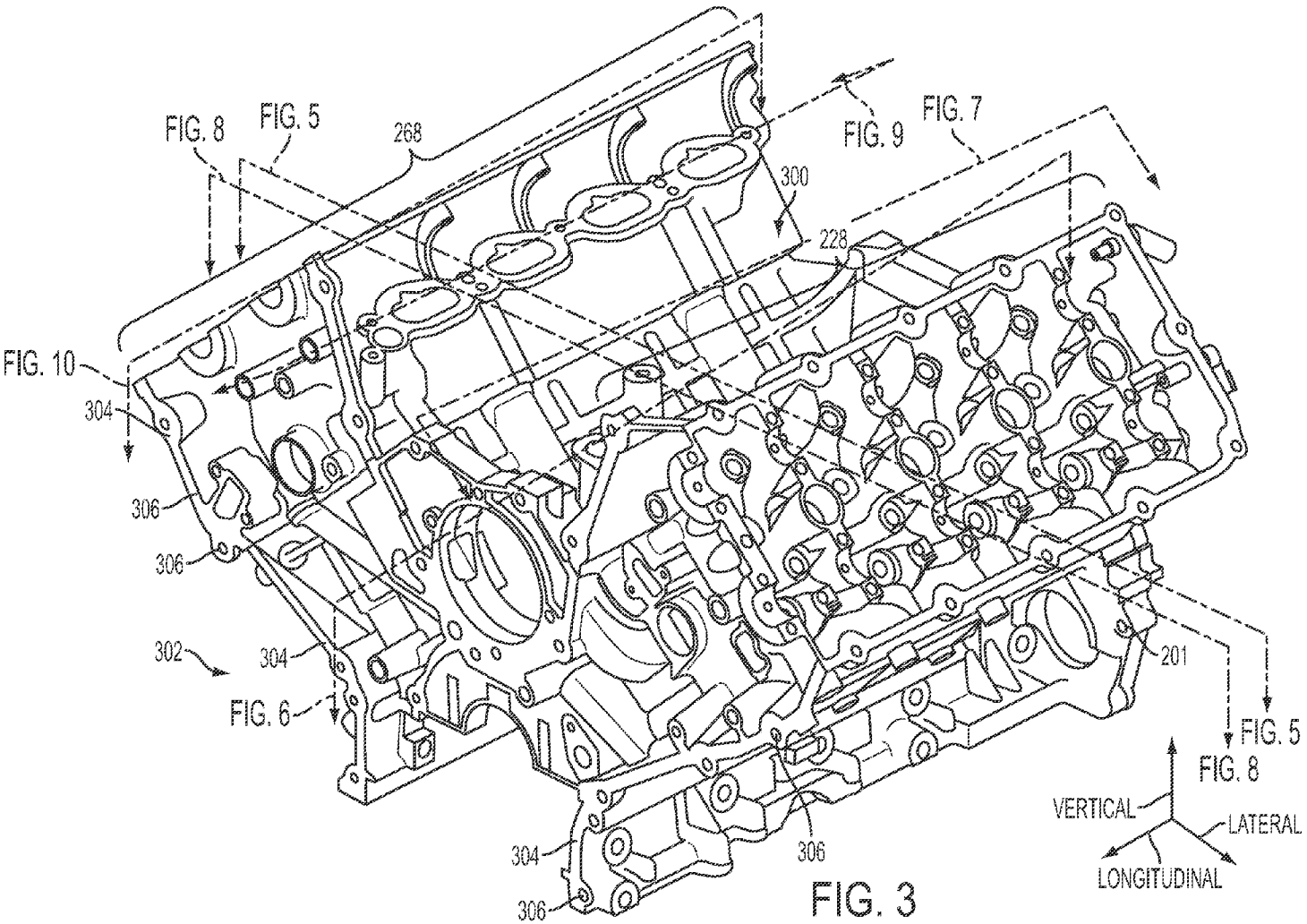
FIGS. 3 and 4 show isometric views of an engine assembly according to an example of the disclosure.

FIG. 3 shows an isometric view of an example of the engine assembly 200 in the engine 10, the engine assembly 200 includes the cylinder block 201, the first cylinder head 228, and the second cylinder head 268, shown in FIG. 2. As shown, the assembly 200 includes the first cylinder head 228 and the second cylinder head 268. A valley 300 is positioned between the cylinder heads.

The cylinder block 201 and the first and second cylinder heads (228 and 268) both include a front side 302 including a front engine cover engaging surface 304 configured to attach to a front engine cover. Attachment openings 306 are included in the front engine cover engaging surface 304. The attachment opening 306 may be configured to receive bolts or other suitable attachment apparatuses for attaching the front cover of the engine to the front engine cover engaging surface 304. However, it will be appreciated that other suitable attachment techniques may be used to attach the engine front cover to the front engine cover engaging surface 304. The cutting planes defining the cross-section shown in FIGS. 5-10 are illustrated in FIG. 3.

Figure 4:
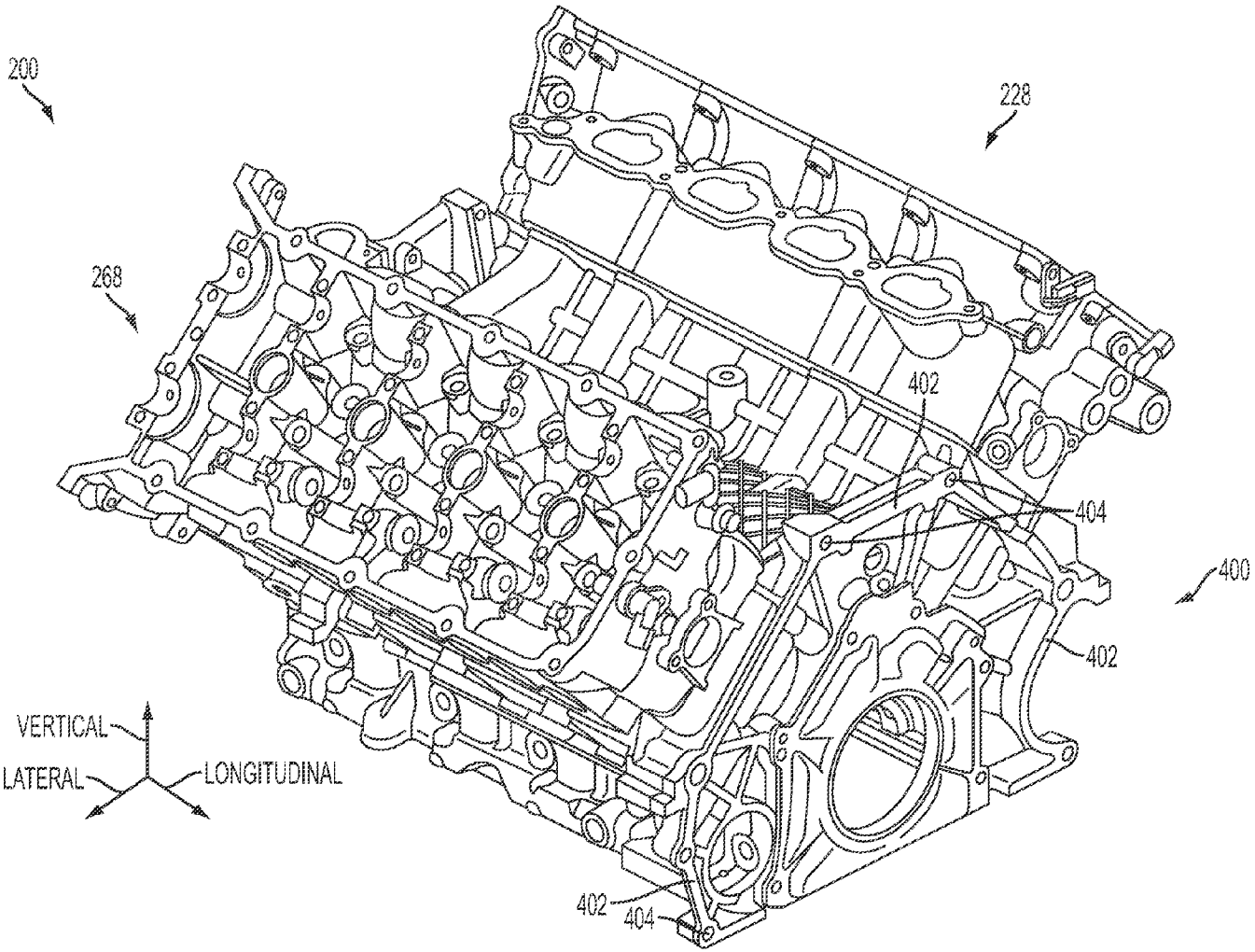

FIG. 4 shows another view of the engine assembly 200 including the cylinder block 201 and the first and second cylinder heads (228 and 268) shown in FIG. 3. Specifically, FIG. 4 shows a rear side 400 of the engine assembly 200. The rear side 400 includes a transmission bell housing engaging surface 402. The transmission bell housing engaging surface 402 is configured to attach to a transmission bell housing. The transmission bell housing engaging surface 402 includes openings 404 configured to accept bolts or other suitable attachment apparatuses, to attach the transmission bell housing engaging surface 402 to the transmission bell housing. However, it will be appreciated that in other examples other suitable attachment techniques may be utilized.

Figure 5:
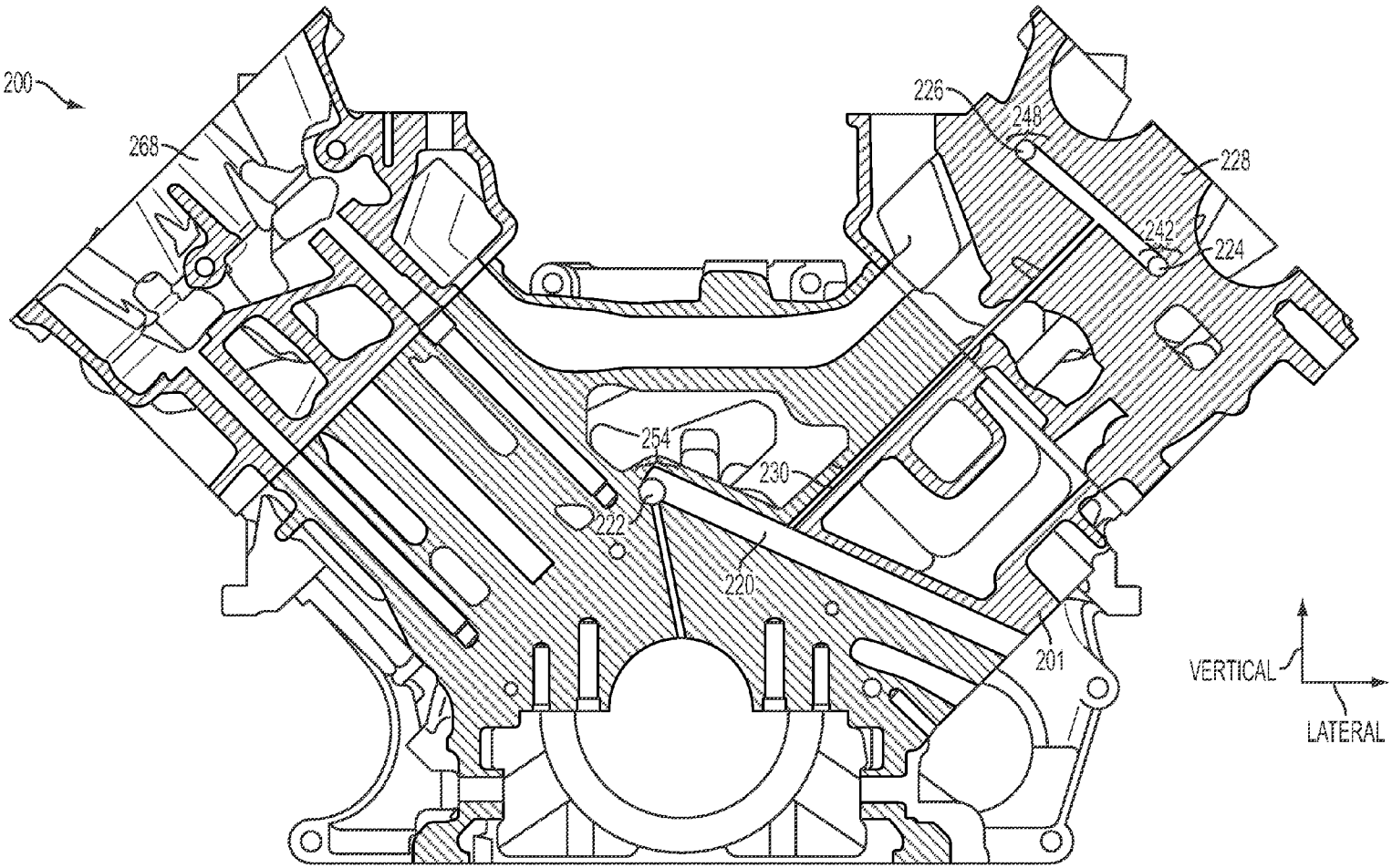

FIG. 5 shows a cross-sectional view of the engine assembly 200 shown in FIGS. 3 and 4. The supply oil passage 220 includes an outlet in fluidic communication with the valley oil gallery passage 222 shown in FIG. 2. The supply oil passage extends through a portion of the cylinder block 201. As previously discussed, the oil passage 230 branches off the supply oil passage 220 and is in fluidic communication with the inlet 242 of the first oil gallery passage 224 included in the first cylinder head 228. The oil passage 230 extends through a portion of the cylinder block 201 and the first cylinder head 228. The oil passage 220 is also in fluidic communication with the inlet 248 of the second oil gallery passage 226 included in the first cylinder head 228. Furthermore, the oil passage 220 is also in fluidic communication with inlet 254 of the valley oil gallery passage 222.

Figure 6:
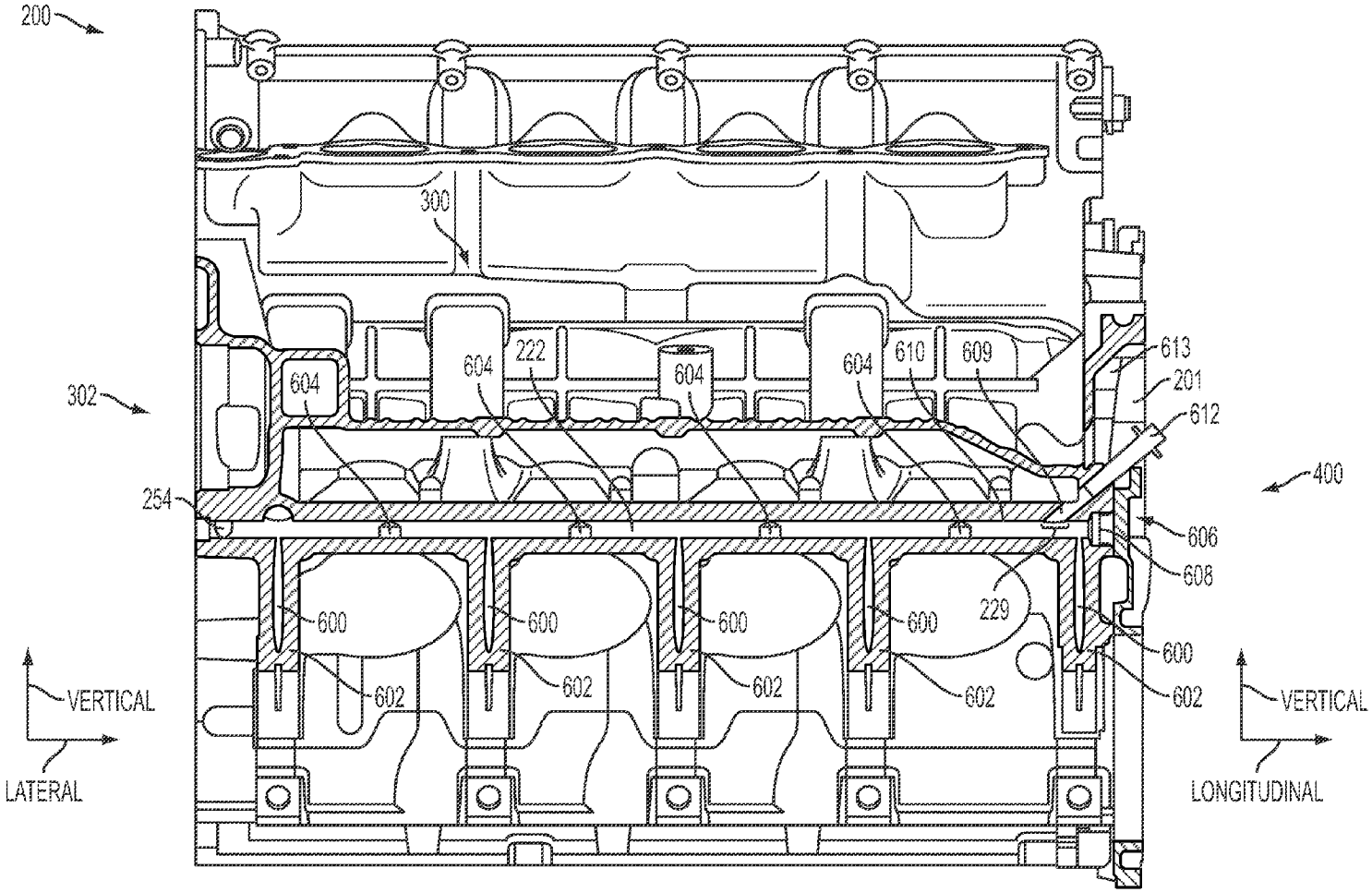

FIG. 6 shows another cross-sectional view of the engine assembly 200 shown in FIG. 4. The valley oil gallery passage 222 is depicted. The valley oil gallery passage 222 extends longitudinally through the engine assembly 200. The valley oil gallery passage 222 is straight in the depicted example. However, in other examples, the valley oil gallery passage 222 may have another suitable geometric configuration. Furthermore, the valley oil gallery passage 222 extends longitudinally through the engine assembly 200 and is positioned below the valley 300. Specifically, the valley oil gallery passage 222 longitudinally traverses the engine assembly 200 from a first peripheral cylinder 1000 included in the second cylinder head 268 to a second peripheral cylinder 1002 included in second cylinder head 268, the first and second peripheral cylinders shown in FIG. 10. Additionally, the valley oil gallery passage 222 extends from the front side 302 of the engine assembly 202 to the rear side 400 of the engine assembly 200.

As shown, the valley oil gallery passage includes the inlet 254 in fluidic communication with the supply oil passage 220 shown in FIG. 5. Branch passages 600 are depicted. The branch passages 600 extend through bearing caps 602 include in the cylinder block 201. It will be appreciated that the branch passages 600 may be configured to supply oil to crankshaft bearings included in a crankshaft assembly. Openings 604 may be in fluidic communication with the piston jets 258, shown in FIG. 2. The valley oil gallery passage 222 includes an end 606 sealed via a stopper 608 (e.g., plug).

The drainage opening 229 is also depicted in FIG. 6. The drainage opening is in fluidic communication with drainage passage 609 traversing the cylinder block 201. As shown, the drainage opening 229 extends into a wall 610 of the valley oil gallery passage 222. Furthermore, the drainage passage 609 extends in a vertical and longitudinal direction in the cylinder block 201. A drainage opening stopper 612 is positioned in the drainage passage 609 sealing the drainage opening 229 and the drainage passage 609. In the depicted example, the drainage opening stopper 612 is a bolt. However, in other examples other suitable drainage opening stoppers may be used. It will be appreciated that during the construction the engine assembly 200, the drainage opening stopper 612 may not be positioned in the drainage passage 609. When the engine assembly 202 is in such a configuration, oil may be flowed through the valley oil gallery passage 222 and out of the drainage opening 229 and drainage passage 609. In this way, the drainage opening stopper 612 is moveable. Furthermore, the drainage opening stopper 612 extends outside of an exterior engine block wall 613 in the depicted example.

Therefore, a position of the drainage opening stopper 612 may be adjustable from outside of the engine block 201. However, other configurations are possible in other examples. It will be appreciated, that the oil flows to the oil reservoir 206, shown in FIG. 2, after flowing out of the drainage passage 609. In this way, oil may be flushed from the lubrication system 202, shown in FIG. 2, prior to complete assembly of the engine assembly 200. Furthermore, the size of the drainage opening 229 may be larger than the size of the inlets of the branch passages 602 or the size of the openings 604. In this way, oil may flow through the drainage opening 229 when the lubrication system is being flushed, as opposed to the branch passages 602 and/or openings 604.

Figure 7:
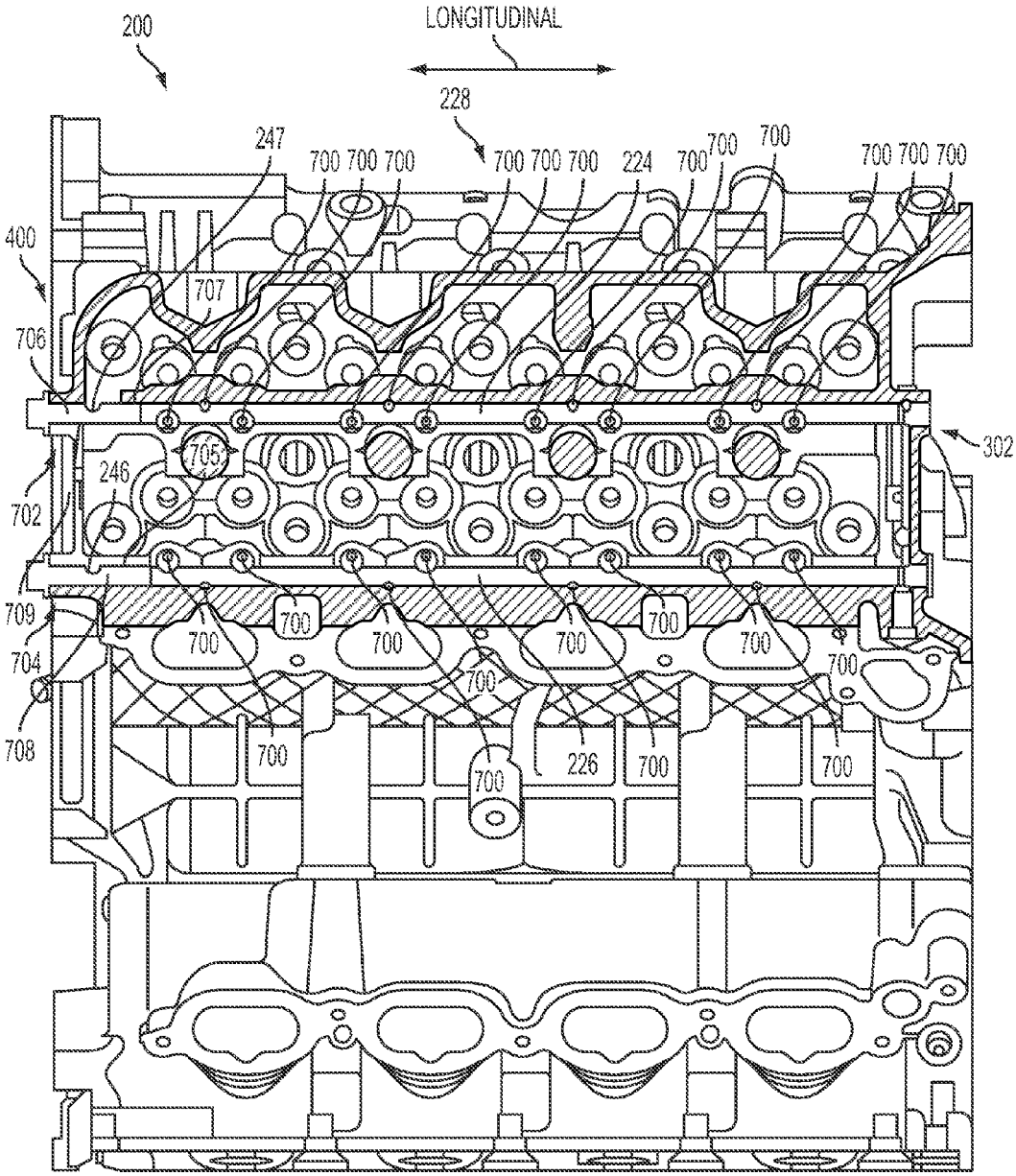

FIG. 7 shows another cross-sectional view of the assembly shown in FIG. 4. The first and second oil gallery passages (224 and 226), included in the first cylinder head 228, are depicted. Outlets 700 are in fluidic communication with the first oil gallery passage 224 and the second oil gallery passage 226 to the moveable engine components 232, shown in FIG. 2, are depicted. In this way, oil may be transferred from the first and second oil gallery passages (224 and 226) in the first cylinder head 228 to the moveable engine components 232, depicted in FIG. 2. As shown, the first and second oil gallery passages (224 and 226) in the first cylinder head 228 extend longitudinally through the first cylinder head 228 and therefore the engine. Specifically, the first and second oil gallery passages (224 and 226) traverse the first cylinder head 228 from the front side 302 to the rear side 400. In this way, oil may be supplied to a large number of moveable engine components, such as hydraulically operated devices, in the engine. Moreover, the first and second oil gallery passages (224 and 226) are shown in a straight line. However, in other examples other passage alignments and geometric configurations are possible. The drainage opening 246 in the firstly oil gallery passage 224 and the drainage opening 247 in the second oil gallery passage are shown in FIG. 7. The drainage opening 246 radially extends into a wall 705 of the first oil gallery passage 224. Likewise, the drainage opening 247 radially extends into a wall 707 of the second oil gallery passage 226. However, in other examples other orientations are possible. Furthermore, the size of the drainage openings (246 and 247) may be greater than the size of the outlets 700.

The first oil gallery passage 224 includes an end 702 and the second oil gallery passage 226 includes an end 704. A drainage opening stopper 706 is positioned within the end 702 of the first oil gallery passage 224. Likewise, a drainage opening stopper 708 is positioned with the end 704 of the second oil gallery passage 226. The drainage opening stoppers (706 and 708) may both be configured to seal the ends of their respectively oil gallery passage as well as seal the drainage openings. In the depicted example, drainage opening stoppers (706 and 708) are bolts. However, in other examples other suitable stoppers may be utilized. It will be appreciated that when the drainage opening stoppers (706 and 708) are removed from the first and second oil gallery passages (224 and 226) oil may drain from the passages to the oil reservoir 206 shown in FIG. 2. Additionally, the drainage opening stoppers (706 and 708) extend outside an exterior cylinder head wall 709. Therefore, the positions of the drainage opening stoppers (706 and 708) may be adjustable from outside of the first cylinder head 228. However, in other examples other configurations are possible.

Figure 8:
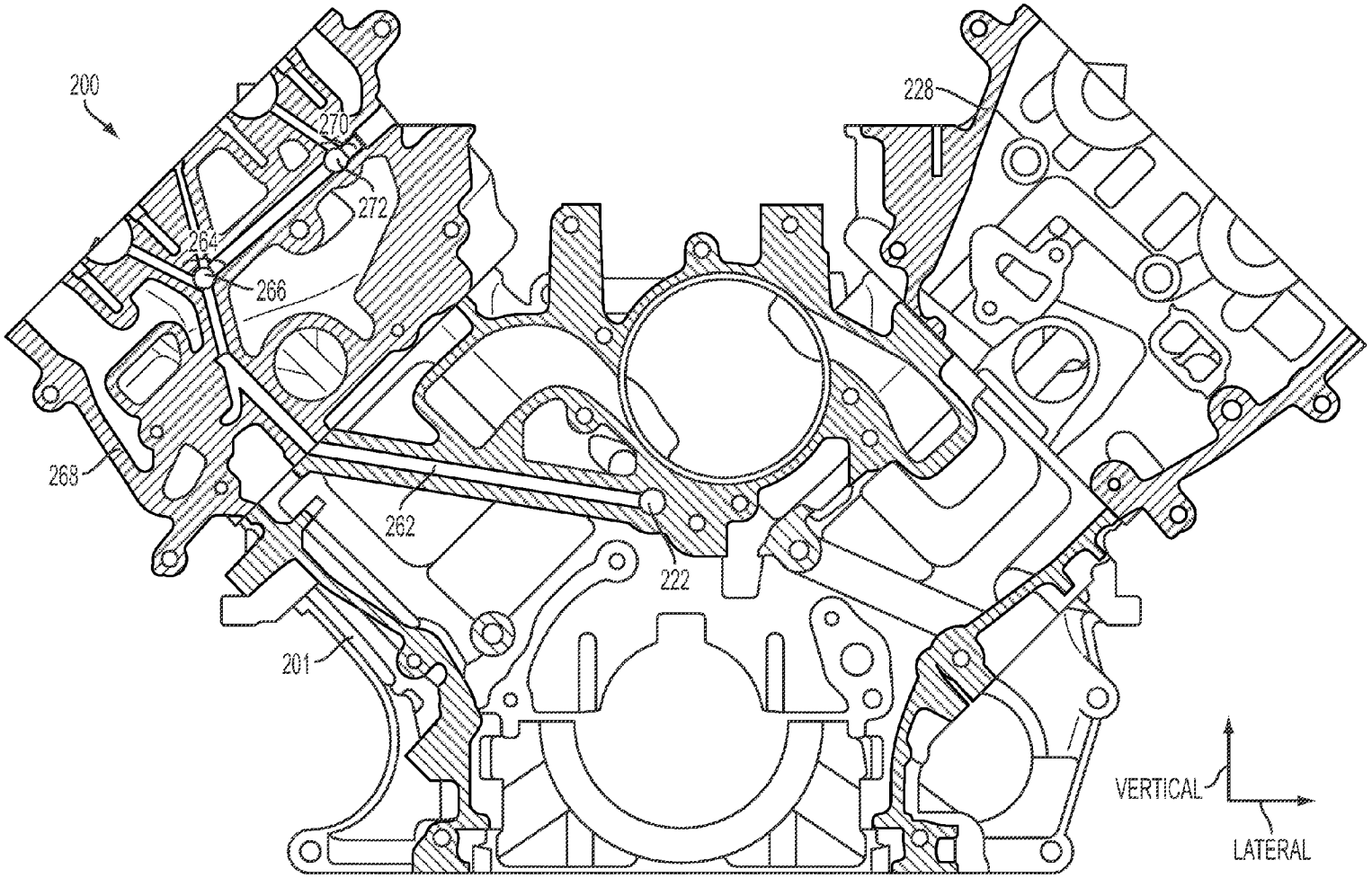

FIG. 8 shows another cross-sectional view of the assembly shown in FIG. 3. FIG. 8 depicts the oil passage 262 shown in FIG. 2. As shown, the oil passage 262 traverses the cylinder block 201 and the second cylinder head 268 and is in fluidic communication with the valley oil gallery passage 222. The oil passage 262 is in fluidic communication with the inlet 264 of the first oil gallery passage 266 included in the second cylinder head 268. Additionally, the oil passage 262 is in fluidic communication with the inlet 270 of the second oil gallery passage 272 included in the second cylinder head 268. In this way, oil may flow into oil gallery passages included in the second cylinder head 268.

Figure 9:
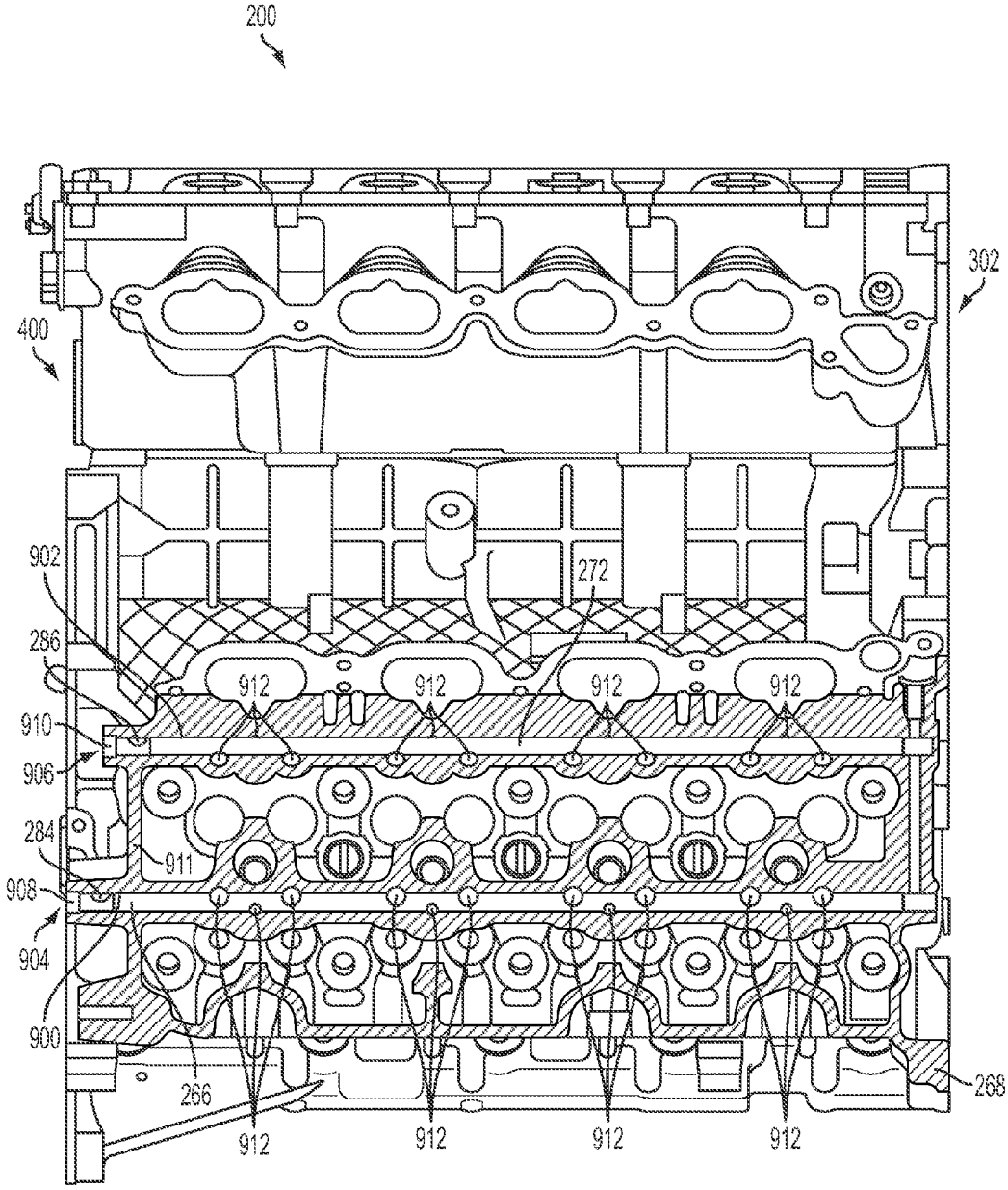

FIG. 9 shows another cross-sectional view of the assembly shown in FIG. 4. The first and second oil gallery passages (266 and 272) included in the second cylinder head 268 are depicted. As shown, the first and second oil gallery passages (266 and 272) longitudinally extend down the second cylinder head 268. Specifically, the first and second oil gallery passages (266 and 272) extend from a front side 302 of the engine assembly 200 to a rear side 400 of the engine assembly. The drainage opening 284 as well as the drainage opening 286 are depicted. As shown, the drainage opening 284 extends through a wall 900 of the first oil gallery passage 266. Likewise, the drainage opening 286 extends through a wall 902 of the second oil gallery passage 272. The drainage opening 284 is positioned adjacent to an end 904 of the first oil gallery passage 266. Likewise, the drainage opening 286 is positioned adjacent to an end 906 of the second oil gallery passage 272. As shown, the drainage opening 284 radially extends into the first oil gallery passage 266. Likewise, the drainage opening 286 radially extends into the second oil gallery passage 272. However, in other examples other orientations are possible. A drainage opening stopper 908 is positioned in the end 904 of the first oil gallery passage 266. The drainage opening stopper 908 is a bolt in the depicted example. However, other types of drainage opening stoppers have been contemplated. The drainage opening stopper 908 seals the end of the first oil gallery passage 266 as well as the drainage opening 284, in the depicted assembled configuration. Specifically, the drainage opening stopper 908 extends across the drainage opening 284 to seal the opening. Another drainage opening stopper 910 is positioned in the second oil gallery passage 272. The drainage opening stopper 910 seals the end of the second oil gallery passage 272 and the drainage opening 286. The drainage opening stoppers (908 and 910) may be removed from the engine assembly 200 to unseal the drainage openings (284 and 286). Subsequently, oil may be flowed through the first and second oil gallery passages (266 and 272) and out of the drainage openings (284 and 286) to flush the lubrication system 202, shown in FIG. 2. Additionally, the drainage opening stoppers (908 and 910) extend outside an exterior cylinder head wall 911. Therefore, the positions of the drainage opening stoppers (908 and 910) may be adjustable from outside of the second cylinder head 268. However, in other examples other configurations are possible.

The first and second oil gallery passages (266 and 272) further include outlets 912. The outlets 912 may be in fluidic communication with the moveable engine components 274, shown in FIG. 2. In this way, oil may be supplied to the moveable engine components 274, shown in FIG. 2. The size of the drainage openings (284 and 286) may be greater than the outlets 912. In this way, oil may flow through the drainage openings (284 and 286) when the drainage openings are unsealed and the lubrication system is being flushed.

Figure 10:
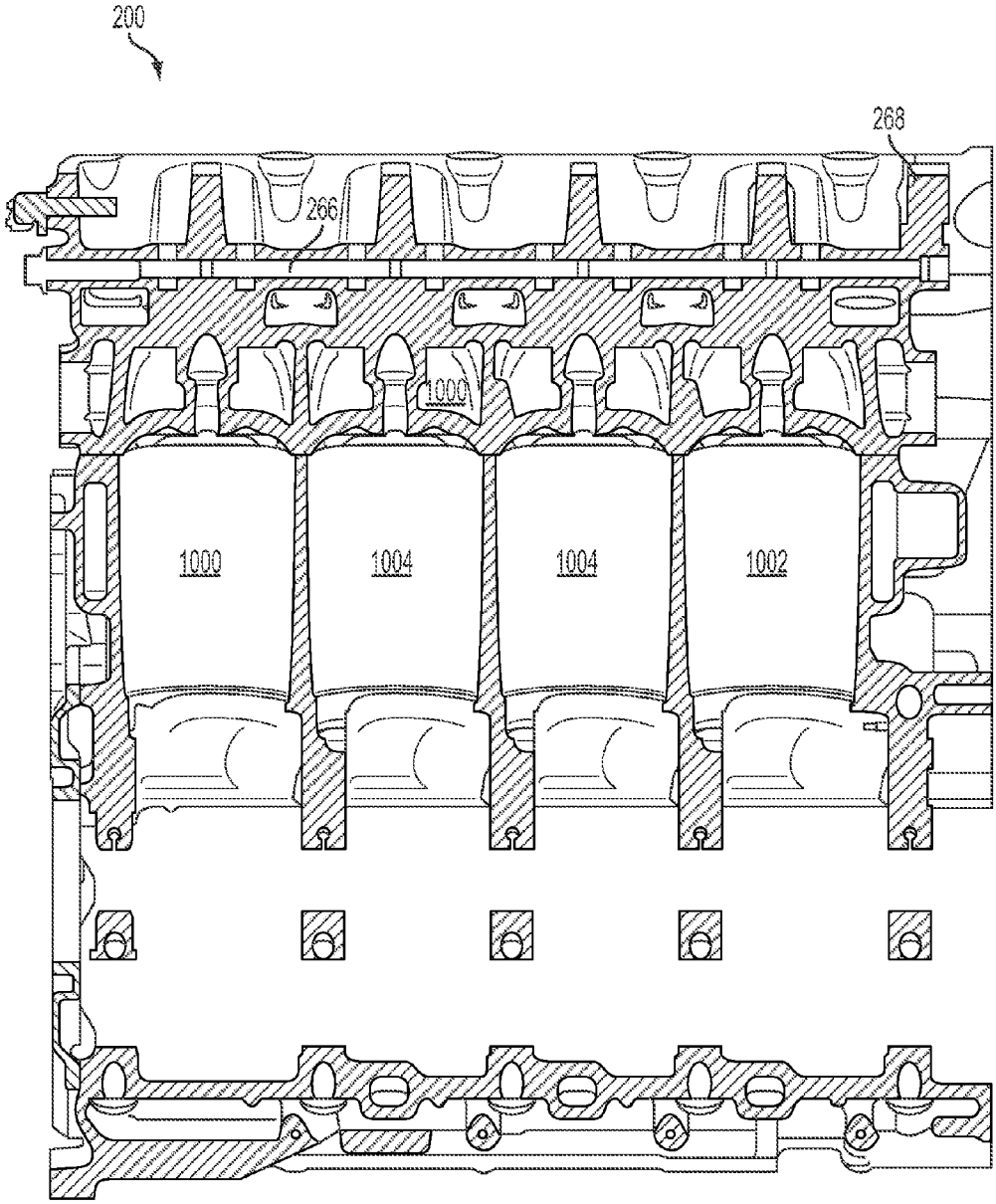

FIG. 10 shows another cross-sectional view of the engine assembly 200 shown in FIG. 3. The engine assembly 200 includes a first peripheral cylinder 1000 and a second peripheral cylinder 1002 included in the second cylinder head 262 and the cylinder block 201. It will be appreciated that the engine assembly may include additional peripheral cylinders in the first cylinder head 228 and the cylinder block 201. Intermediary cylinders 1004 are also depicted. In the depicted embodiment, four cylinders are shown, which are half of the engine's cylinders. However, in other examples the engine assembly 200 may include an alternate number of cylinders. Additionally, the first oil gallery passage 266 is also depicted.

Thus, the engine illustrated in FIGS. 1-10 provides for an engine lubrication system comprising an engine block including an oil gallery passage extending through the engine block and supplying oil to a group of one or more moveable engine components, the oil gallery passage supplied oil from an oil pump, the oil gallery passage in fluidic communication with a drainage passage, and a movable stopper positioned in the drainage passage that selectively bypasses oil from the oil pump to an oil reservoir. The stopper and drainage passages may be threaded or may include another stopper retaining means.

The engine illustrated in FIGS. 1-10 further provides for an engine lubrication system where the drainage passage bypasses oil flow past the group of one or more moveable engine components to the oil reservoir.

The engine illustrated in FIGS. 1-10 further provides for an engine lubrication system where the moveable stopper bypasses around the group of one or more moveable engine components in a first position, and where the moveable stopper stops oil flow through the drain passage and directs oil to the group of one or more moveable engine components in a second position.

The engine illustrated in FIGS. 1-10 further provides for an engine lubrication system where the group of one or more engine components includes a hydraulically operated device, and where the hydraulically operated device is positioned upstream of the drainage passage. The engine illustrated in FIGS. 1-10 further provides for an engine lubrication system where a position of the movable stopper is adjustable from outside of the engine block. The engine illustrated in FIGS. 1-10 further provides for an engine lubrication system where the oil gallery passage is in fluidic communication with one or more cylinder heads.

The engine illustrated in FIGS. 1-10 further provides for an engine lubrication system further comprising an oil filter positioned downstream of the oil pump and the oil reservoir. The engine illustrated in FIGS. 1-10 further provides for an engine lubrication system where the oil filter is positioned upstream of the oil gallery passage.

The engine illustrated in FIGS. 1-10 also provides for an engine lubrication system comprising an engine block including a first oil drainage passage in fluidic communication with a first oil gallery, a first stopper positioned in the first oil drainage passage extending outside of an exterior engine block wall, a cylinder head coupled to the engine block and including a second oil drainage passage, and a second stopper positioned in the second oil drainage passage extending outside an exterior cylinder head wall. The engine illustrated in FIGS. 1-10 further provides for an engine lubrication system further comprising a second oil gallery within the cylinder head and in fluidic communication with the second oil drainage passage and the first oil gallery, the second oil gallery positioned between the second oil drainage passage and the first oil gallery.

The engine illustrated in FIGS. 1-10 further provides for an engine lubrication system further comprising a third oil gallery within the cylinder head and in fluidic communication with the second oil gallery and the first oil gallery, the second oil drainage passage directing oil to an oil reservoir. The engine illustrated in FIGS. 1-10 further provides for an engine lubrication system further comprising a third drainage passage in fluidic communication with the third oil gallery, the third drainage passage directing oil to the oil reservoir.

The engine illustrated in FIGS. 1-10 further provides for an engine lubrication system where the first stopper allows oil to bypass a hydraulically operated device and flow to an oil reservoir when in a first position, and where the first stopper prevents oil from bypassing the hydraulically operated device and seals the oil drainage passage when in a second position. The engine illustrated in FIGS. 1-10 further provides for an engine lubrication system further comprising an oil filter coupled to the engine block and filtering oil provided to the first oil gallery.

Figure 11:
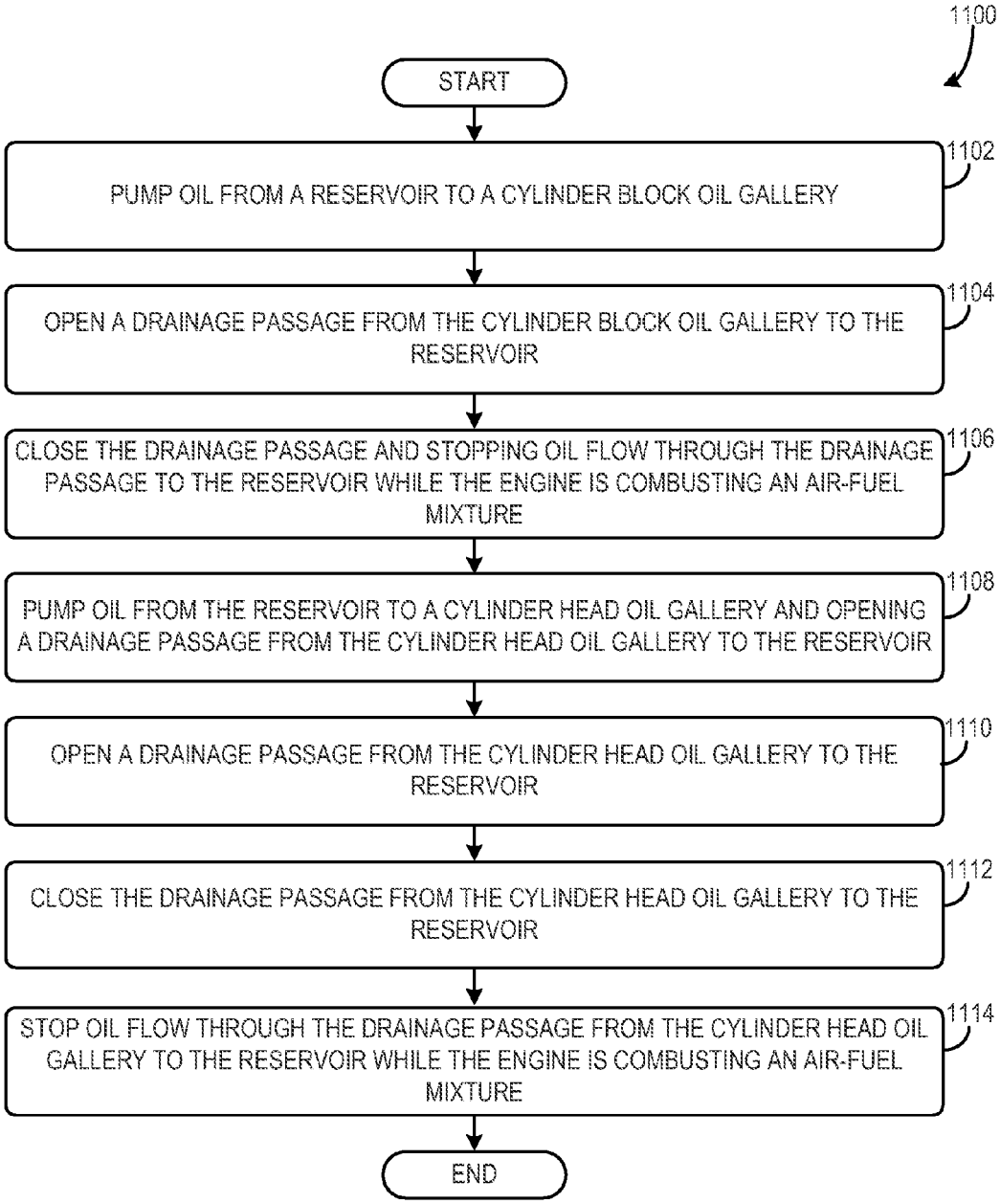
FIG. 11 shows a method for operation of a lubrication system.

FIG. 11 shows a method 1100 for operation of a lubrication system in an engine assembly. The engine assembly described above with regard to FIGS. 1-9 may be used to implement method 1100 or another suitable engine may be used to implement method 1100.

At 1102, the method includes pumping oil from a reservoir to a cylinder block oil gallery. At 1104 the method further includes opening a drainage passage from the cylinder block oil gallery to the reservoir.

Next at 1106 the method includes closing the drainage passage and stopping oil flow through the drainage passage to the reservoir while the engine is combusting an air-fuel mixture. In some examples, the engine is not combusting an air-fuel mixture when the drainage passage is open. Further in some examples, the drainage passage is closed via a stopper.

At 1108 the method includes pumping oil from the reservoir to a cylinder head oil gallery and at 1110 the method includes opening a drainage passage from the cylinder head oil gallery to the reservoir. At 1112 the method includes closing the drainage passage from the cylinder head oil gallery to the reservoir. Next at 1114 the method includes stopping oil flow through the drainage passage from the cylinder head oil gallery to the reservoir while the engine is combusting an air-fuel mixture. In some examples, the cylinder block oil gallery supplies oil to one or more pistons.

Method 1100 enables the oil gallery passage to be flushed of any unwanted particulates prior to full assembly of the engine assembly. In this way, the likelihood of unwanted particulates in the oil flowing through the hydraulic devices is reduced. As a result, the longevity of the engine assembly is increased.

The method shown in FIG. 11 provides for a method for operating a lubrication system of an engine, comprising pumping oil from a reservoir to a cylinder block oil gallery, opening a drainage passage from the cylinder block oil gallery to the reservoir, and closing the drainage passage and stopping oil flow through the drainage passage to the reservoir while the engine is combusting an air-fuel mixture. The method shown in FIG. 11 further provides for a method where the engine is not combusting an air-fuel mixture when the drainage passage is open and/or where the drainage passage is closed via a stopper.

The method shown in FIG. 11 also provided for a method further comprising pumping oil from the reservoir to a cylinder head oil gallery and opening a drainage passage from the cylinder head oil gallery to the reservoir. The method shown in FIG. 11 also provided for a method further comprising closing the drainage passage from the cylinder head oil gallery to the reservoir and stopping oil flow through the drainage passage from the cylinder head oil gallery to the reservoir while the engine is combusting an air-fuel mixture. The method shown in FIG. 11 further provides for a method where the cylinder block oil gallery supplies oil to one or more pistons.

As will be appreciated by one of ordinary skill in the art, the method described in FIG. 11 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, single cylinder, I2, I3, I4, I5, V6, V8, V10, V12 and V16 engines operating in natural gas, gasoline, diesel, or alternative fuel configurations could use the present description to advantage.

The invention claimed is:

1. An engine lubrication system, comprising:

an engine block including an oil gallery passage extending through the engine block and supplying oil to a group of one or more moveable engine components, the oil gallery passage supplied oil from an oil pump, the oil gallery passage in fluidic communication with a drainage passage; and a movable stopper positioned in the drainage passage that selectively bypasses oil from the oil pump to an oil reservoir.

2. The engine lubrication system of claim 1, where the drainage passage bypasses oil flow past the group of one or more moveable engine components to the oil reservoir.

3. The engine lubrication system of claim 2, where the moveable stopper bypasses around the group of one or more moveable engine components in a first position, and where the moveable stopper stops oil flow through the drain passage and directs oil to the group of one or more moveable engine components in a second position.

4. The engine lubrication system of claim 3, where the group of one or more engine components includes a hydraulically operated device, and where the hydraulically operated device is positioned upstream of the drainage passage.

5. The engine lubrication system of claim 1, where a position of the movable stopper is adjustable from outside of the engine block.

6. The engine lubrication system of claim 1, where the oil gallery passage is in fluidic communication with one or more cylinder heads.

7. The engine lubrication system of claim 1, further comprising an oil filter positioned downstream of the oil pump and the oil reservoir.

8. The engine lubrication system of claim 7, where the oil filter is positioned upstream of the oil gallery passage.

9. An engine lubrication system, comprising:

an engine block including a first oil drainage passage in fluidic communication with a first oil gallery;

a first stopper positioned in the first oil drainage passage extending outside of an exterior engine block wall;

a cylinder head coupled to the engine block and including a second oil drainage passage; and a second stopper positioned in the second oil drainage passage extending outside an exterior cylinder head wall.

10. The engine lubrication system of claim 9, further comprising a second oil gallery within the cylinder head and in fluidic communication with the second oil drainage passage and the first oil gallery, the second oil gallery positioned between the second oil drainage passage and the first oil gallery.

11. The engine lubrication system of claim 10, further comprising a third oil gallery within the cylinder head and in fluidic communication with the second oil gallery and the first oil gallery, the second oil drainage passage directing oil to an oil reservoir.

12. The engine lubrication system of claim 11, further comprising a third drainage passage in fluidic communication with the third oil gallery, the third drainage passage directing oil to the oil reservoir.

13. The engine lubrication system of claim 9, where the first stopper allows oil to bypass a hydraulically operated device and flow to an oil reservoir when in a first position, and where the first stopper prevents oil from bypassing the hydraulically operated device and seals the oil drainage passage when in a second position.

14. The engine lubrication system of claim 9, further comprising an oil filter coupled to the engine block and filtering oil provided to the first oil gallery.

15. A method for operating a lubrication system of an engine, comprising:

pumping oil from a reservoir to a cylinder block oil gallery;

opening a drainage passage from the cylinder block oil gallery to the reservoir; and closing the drainage passage and stopping oil flow through the drainage passage to the reservoir while the engine is combusting an air-fuel mixture.

16. The method of claim 15, where the engine is not combusting an air-fuel mixture when the drainage passage is open.

17. The method of claim 15, where the drainage passage is closed via a stopper.

18. The method of claim 15, further comprising pumping oil from the reservoir to a cylinder head oil gallery and opening a drainage passage from the cylinder head oil gallery to the reservoir.

19. The method of claim 18, further comprising closing the drainage passage from the cylinder head oil gallery to the reservoir and stopping oil flow through the drainage passage from the cylinder head oil gallery to the reservoir while the engine is combusting an air-fuel mixture.

20. The method of claim 15, where the cylinder block oil gallery supplies oil to one or more pistons.

* * * * *